US006653800B2

(12) United States Patent
Chen

(10) Patent No.: US 6,653,800 B2
(45) Date of Patent: Nov. 25, 2003

(54) BALLAST CIRCUIT WITH LAMP CATHODE PROTECTION AND BALLAST PROTECTION

(75) Inventor: Timothy Chen, Cleveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,990

(22) Filed: Nov. 6, 2001

(65) Prior Publication Data

US 2003/0085670 A1 May 8, 2003

(51) Int. Cl.[7] ..... H05B 37/00

(52) U.S. Cl. ..... 315/244; 315/283; 315/307; 315/291

(58) Field of Search ..... 315/244, 260, 315/283, 287, 291, 307, 334, DIG. 2, DIG. 5, DIG. 7

(56) References Cited

U.S. PATENT DOCUMENTS 5,187,411 A 2/1993 Boyd et al. ..... 315/247
5,355,055 A * 10/1994 Tary ..... 315/209 R
5,436,529 A * 7/1995 Bobel ..... 315/127
5,932,974 A 8/1999 Wood ..... 315/119

* cited by examiner

*Primary Examiner*—Don Wong
*Assistant Examiner*—Thuy Vinh Tran
(74) *Attorney, Agent, or Firm*—Fay, Sharpe, Fagan, Minnich & McKee, LLP

(57) ABSTRACT

A ballast circuit for driving a fluorescent lamp is provided. The ballast circuit comprises: a self-oscillating circuit; and a series resonant circuit. The series resonant circuit comprises: an inductor; a capacitor; and two diodes. The arrangement of the series resonant circuit: a) causes less power to be dissipated by first and second lamp cathodes when a lamp is coupled to the ballast circuit and increases lamp life, b) protects the ballast circuit from self-destruction when no lamp is coupled to the ballast circuit, and protects the ballast circuit from self-destruction when either the first, second, or both cathodes of a lamp coupled to the ballast circuit have failed.

16 Claims, 6 Drawing Sheets

BALLAST CIRCUIT WITH LAMP CATHODE PROTECTION AND BALLAST PROTECTION

BACKGROUND OF INVENTION

The present invention relates generally to a ballast circuit for fluorescent lamps. More particularly, this invention relates to a self-oscillating electronic ballast circuit with cathode protection during normal operation and ballast protection during no-lamp and cathode failure conditions.

FIG. 1 shows a ballast circuit 100 with a series-resonant parallel-loaded electronic ballast having an inherent open-cathode protection function. The open-cathode protection function is provided by placing a resonant capacitor 112 between the two cathodes 114, 116 of the fluorescent lamp 118. If the fluorescent lamp 118 is removed from the ballast circuit 100, or if one or two of the cathodes 114, 116 fail (i.e., cathode current path opens), the resonant inductor 120 is disconnected from the resonant capacitor 112. With the resonant circuit disconnected, the self-oscillating electronic ballast is disabled. Upon replacing the lamp 118, the ballast circuit 100 will resume its normal operation. However, the resonant current that flows through the resonant capacitor 112 during normal operation also flows through each of the cathodes 114, 116. The continuous resonant current can cause overheating of the cathodes 114, 116, reduces the life of the cathodes 114, 116, and reduces the lumens per watt (LPW) of the lamp 118.

FIG. 2 shows another ballast circuit 200 with a series-resonant parallel-loaded electronic ballast with reduced cathode current and a corresponding reduction in power dissipation by the cathodes during normal operation. The ballast circuit 200 achieves reduced cathode current by splitting the resonant capacitance between two capacitors (i.e., capacitor 212 and capacitor 214). Capacitor 212 is between the two cathodes 216, 218 of the fluorescent lamp 220, like in FIG. 1. However, capacitor 214 is in parallel with the two cathodes 216, 218. In this arrangement, the current that flows through cathodes 216, 218 during normal operation of the lamp 220 is reduced. Likewise, the corresponding power dissipated by the cathodes 216, 218 during normal operation is reduced. However, under a no-lamp condition the resonant circuit formed by capacitor 214 and resonant inductor 222 is still intact and continues to conduct current. Furthermore, with the lamp 220 removed, the resonant circuit will have a higher voltage and higher current than with the lamp 220 installed. This could result in damage to the ballast under the no-lamp condition.

SUMMARY OF INVENTION

In one aspect of the present invention a ballast circuit for driving a fluorescent lamp is provided. The ballast circuit comprises: a self-oscillating circuit; and a series resonant circuit.

In another aspect of the present invention a ballast circuit for driving a fluorescent lamp is provided. The ballast circuit comprises: a self-oscillating circuit; a resonant inductor; a resonant capacitor; a first diode; and a second diode.

In another aspect of the present invention a series resonant circuit for a ballast circuit, wherein the ballast circuit is adapted for driving a fluorescent lamp is provided. The series resonant circuit comprises: a resonant inductor; a resonant capacitor; a first diode; and a second diode.

DETAILED DESCRIPTION

The present invention provides a cost-effective no-lamp and lamp cathode failure protection schemes for a series-resonant parallel-loaded electronic ballast. The invention also reduces the power dissipation of lamp cathodes during normal operation.

Figure 1:
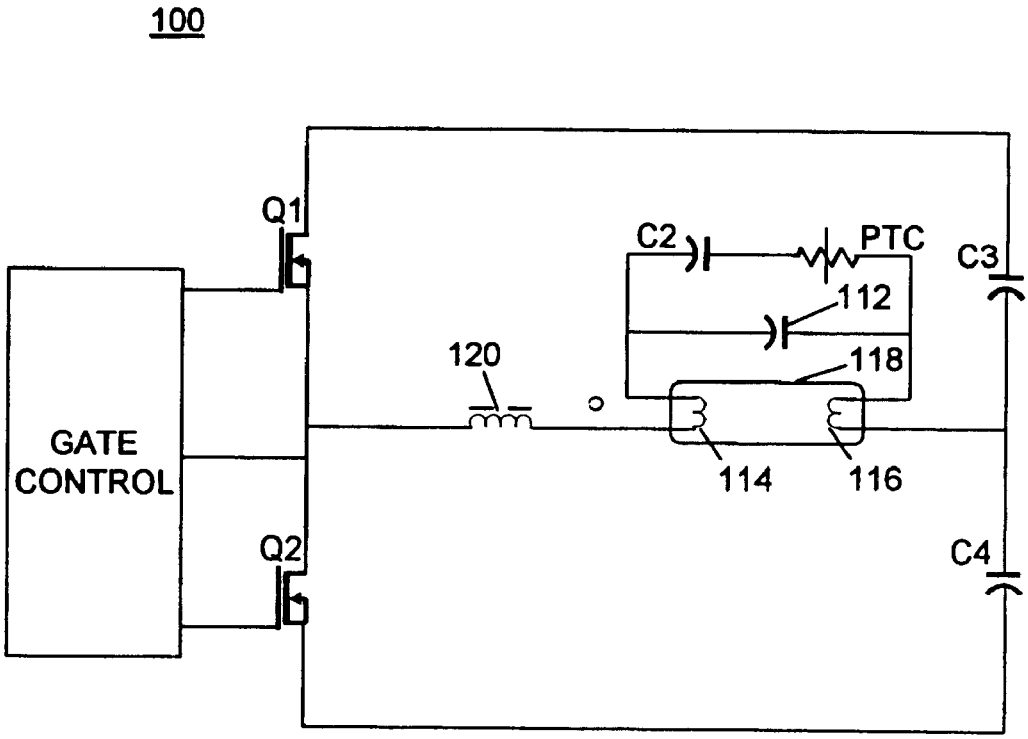
FIG. 1 (PRIOR ART)
FIG. 1 is a schematic diagram of a ballast circuit with ballast protection in a no-lamp and lamp cathode failure conditions.
Figure 2:
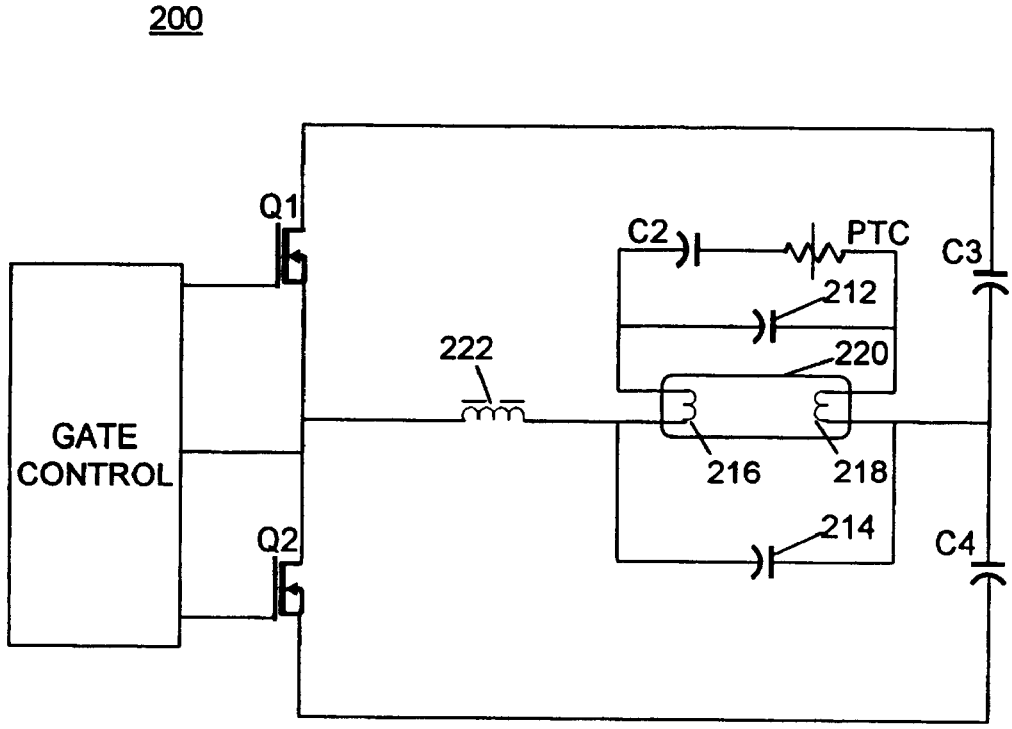
FIG. 2 (PRIOR ART)
FIG. 2 is a schematic diagram of a ballast circuit with lamp cathode protection during normal operation.
Figure 3:
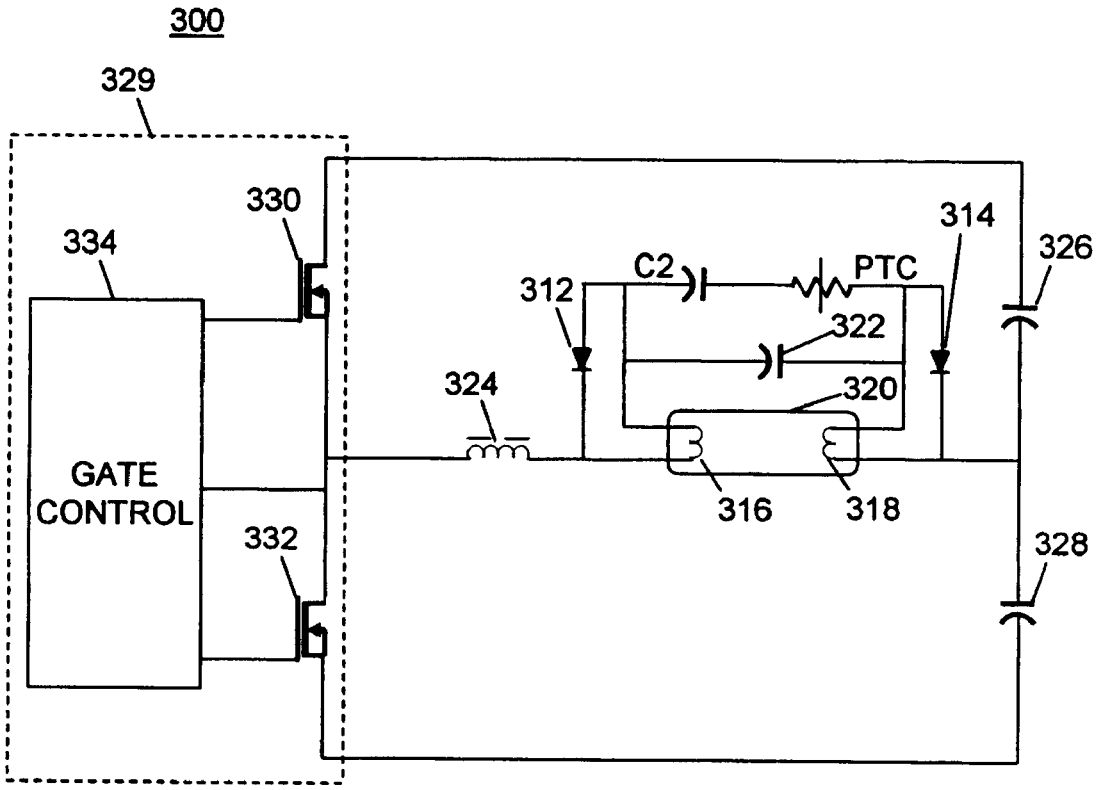
FIG. 3 is a schematic diagram of a ballast circuit in accordance with the present invention during normal operation.

FIG. 3 shows a ballast circuit 300 for fluorescent lamps in normal operation. In this embodiment, the invention adds two diodes 312, 314 to the ballast circuit 100 of FIG. 1. Each diode (e.g., 312 or 314) is across a cathode (e.g., 316 or 318) of the lamp 320. The anode of diode 312 is coupled to a first lead of resonant capacitor 322 and the cathode of diode 312 is coupled to the resonant inductor 324. The anode of diode 314 is coupled to a second lead of resonant capacitor 322 and the cathode of diode 314 is coupled to the half-bridge formed by the junction of capacitor 326 and capacitor 328. As described and shown, both of the diodes 312, 314 are added to a series resonant circuit in a serial fashion. The series resonant circuit is comprised of a resonant inductor 324, a first diode 312, a resonant capacitor 322, and a second diode 314. The specific arrangement of the two diodes 312, 314 is referred to as a back-to-back arrangement with respect to the resonant capacitor 322. In an alternate embodiment, both diodes 312, 314 can be reversed. In other words, the cathodes of both diodes 312, 314 can be coupled to opposing leads of the resonant capacitor 322 in a cathode-to-cathode arrangement. In this arrangement, the anode of diode 312 is coupled to the resonant inductor 324 and the anode of diode 314 is coupled to the junction of capacitor 326 and capacitor 328.

In either embodiment of the diodes, the ballast circuit 300 is protected from over voltage and current stress, when the lamp 320 is removed from the circuit 300 (i.e., no-lamp condition) or when one or both cathodes 316, 318 of the lamp 320 fail. Under no-lamp or cathode failure conditions, the invention causes the self-oscillating circuit 329 formed by semiconductor switch 330, semiconductor switch 332, and gate control 334 to be disabled and placed in a sleeping mode. Upon replacing the lamp 320, the circuit automatically returns to its normal operating mode.

As shown in FIG. 3, the two diodes 312, 314, one across each cathode 316, 318 of the lamp 320, are added to a self-oscillating series-resonant parallel-loaded electronic ballast circuit 300. In this arrangement, during normal operation, each cathode 316, 318 carries operating current during alternating half cycles of current through the resonant circuit. Accordingly, the corresponding diode 312 or 314, rather than the cathode 316 or 318 carries the resonant circuit current during the opposite alternating half cycle. This reduces power dissipation for each cathode 316, 318 of the fluorescent lamp by approximately an inverse of the square root of two. Cathode life and system efficacy are increased because less power is dissipated by each of the cathodes 316, 318 at steady-state conditions during normal operation.

Figure 4:
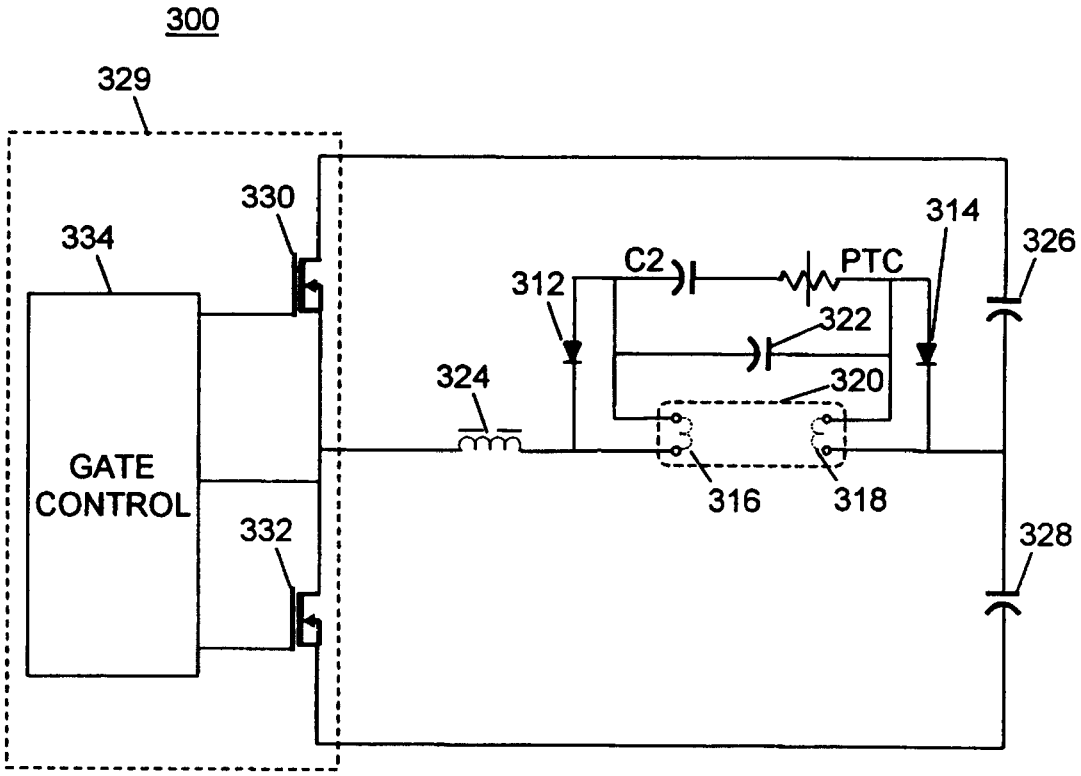
FIG. 4 is a schematic diagram of the ballast circuit of FIG. 3 in a no-lamp condition.

FIG. 4 shows the ballast circuit 300 in a no-lamp condition. If the no-lamp condition occurs (i.e., lamp 320 removed or both cathodes 316, 318 fail) the self-oscillating condition of the ballast circuit 300 is not met because the back-to-back arrangement of the diodes 312, 314 substantially blocks operating current from flowing in the resonant circuit. Therefore, the ballast circuit 300 is protected from self-destruction during the no-lamp condition.

Figure 5:
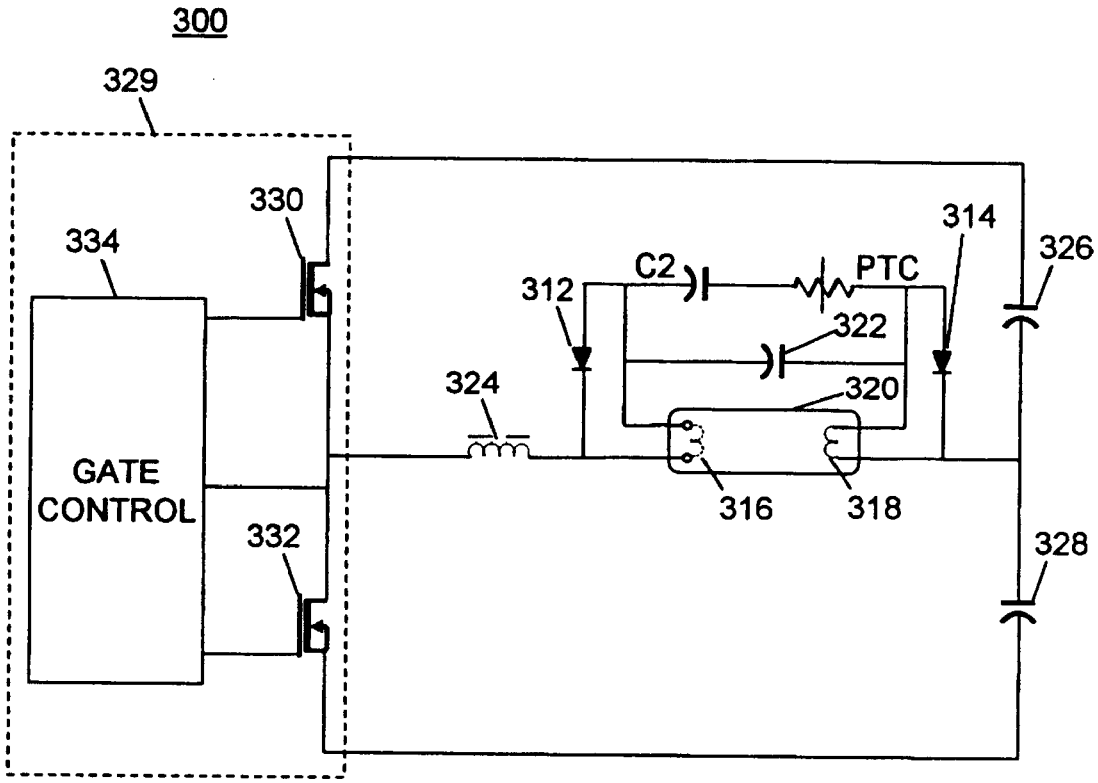
FIG. 5 is a schematic diagram of the ballast circuit of FIG. 3 with a lamp cathode failure condition.

FIG. 5 shows the ballast circuit 300 with a lamp cathode failure condition. When one cathode (e.g., 316) fails or breaks, the filament in the cathode 316 opens and the associated diode 312 is the only path for operating current through the resonant circuit. Since the diode 312 will only permit operating current to flow when it is forward biased, when the oscillating circuit voltage reverse biases the diode 312, the diode 312 prevents operating current through the resonant circuit and prevents the ballast circuit from self-oscillating. If cathode 318 fails, the diode 314 and cathode 318 arrangement operates in the same fashion for the opposite cycle of operating current through the resonant circuit.

Figure 6:
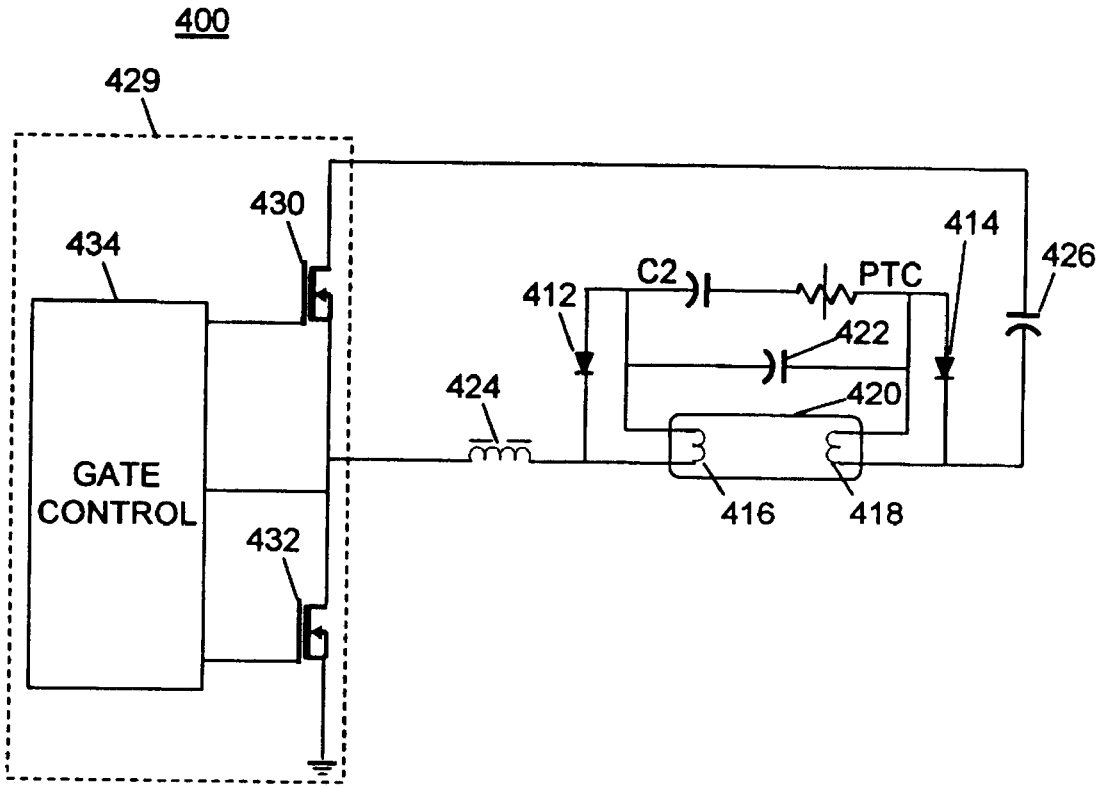
FIG. 6 is a schematic diagram of an alternate embodiment of a ballast circuit in accordance with the present invention.

FIG. 6 shows an alternate embodiment of a ballast circuit 400 employing the present invention. The present invention operates the same in this embodiment as described in the previous embodiment of FIGS. 3–5. In the embodiment shown in FIG. 6, the invention adds two diodes 412, 414 to a self-oscillating ballast circuit. Each diode (e.g., 412 or 414) is across a cathode (e.g., 416 or 418) of the lamp 420. The anode of diode 412 is coupled to a first lead of resonant capacitor 422 and the cathode of diode 412 is coupled to the resonant inductor 424. The anode of diode 414 is coupled to a second lead of resonant capacitor 422 and the cathode of diode 414 is coupled to a first lead of capacitor 426. As described and shown, both of the diodes 412, 414 are added to a series resonant circuit in a serial fashion. The series resonant circuit is comprised of a resonant inductor 424, a first diode 412, a resonant capacitor 422, and a second diode 414. The specific arrangement of the two diodes 412, 414 is referred to as a back-to-back arrangement with respect to the resonant capacitor 422. In an alternate embodiment, both diodes 412, 414 can be reversed. In other words, the cathodes of both diodes 412, 414 can be coupled to opposing leads of the resonant capacitor 422 in a cathode-to-cathode arrangement. In this arrangement, the anode of diode 412 is coupled to the resonant inductor 424 and the anode of diode 414 is coupled to a capacitor 426.

In either embodiment of the diodes, the ballast circuit 400 is protected from over voltage and current stress, when the lamp 420 is removed from the circuit 400 (i.e., no-lamp condition) or when one or both cathodes 416, 418 of the lamp 420 fail. Under no-lamp or cathode failure conditions, the invention causes the self-oscillating circuit 429 formed by semiconductor switch 430, semiconductor switch 432, and gate control 434 to be disabled and placed in a sleeping mode. Upon replacing the lamp 420, the circuit automatically returns to its normal operating mode.

As shown in FIG. 6, the two diodes 412, 414, one across each cathode 416, 418 of the lamp 420, are added to a self-oscillating series-resonant parallel-loaded electronic ballast circuit 400. In this arrangement, during normal operation, each cathode 416, 418 carries the operating current during alternating half cycles of current through the resonant circuit. Accordingly, the diode 412, 414, rather than the cathode 416, 418, carries the resonant circuit current during the opposite alternating half cycle. This reduces power dissipation for each cathode 416, 418 of the fluorescent lamp by approximately an inverse of the square root of two. Cathode life and system efficacy are increased because less power is dissipated by each of the cathodes 416, 418 at steady-state conditions during normal operation.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed:

1. A ballast circuit for driving a fluorescent lamp, comprising:

a self-oscillating circuit for producing a periodic a.c. signal having a first cycle and a second cycle; and a series resonant circuit operationally coupled to the self-oscillating circuit and adapted for operationally coupling with a first and second cathode of the lamp, the resonant circuit further including:

a resonant inductor operationally coupled to the self-oscillating circuit, a resonant capacitor, a first diode with an anode lead and a cathode lead operationally coupled between the resonant inductor and resonant capacitor and adapted for operationally coupling across the first cathode of the lamp, and a second diode with an anode lead and a cathode lead operationally coupled between the resonant capacitor and the self-oscillating circuit, wherein the leads of the second diode are in an opposite orientation from the leads of the first diode with respect to the series resonant circuit, and the second diode being adapted for operationally coupling across the second cathode of the lamp;

wherein at least one of the first and second diodes substantially blocks resonant circuit current from flowing during a predetermined first or second cycle of the self-oscillating circuit when the lamp is coupled to the ballast circuit and one or more of the first and second cathodes of the lamp has failed.

2. The ballast circuit of claim 1, wherein the first diode provides half wave rectification of the voltage across the first cathode of the lamp when the lamp is coupled to the ballast circuit.

3. The ballast circuit of claim 2, wherein the second diode provides half wave rectification of the voltage across the second cathode of the lamp when the lamp is coupled to the ballast circuit.

4. The ballast circuit of claim 3, wherein the half wave rectification of the voltage across the first and second cathodes of the lamp when the lamp is coupled to the ballast circuit reduces the power dissipated by each cathode and increases lamp life.

5. The ballast circuit of claim 1, wherein the first diode substantially blocks resonant circuit current from flowing during a predetermined first or second cycle of the self-oscillating circuit when the lamp is coupled to the ballast circuit and the first cathode of the lamp has failed.

6. The ballast circuit of claim 5, wherein the self-oscillating circuit is prevented from oscillating and the ballast circuit is protected from self-destruction when a lamp is coupled to the ballast circuit and the first cathode of the lamp has failed.

7. The ballast circuit of claim 1, wherein the second diode substantially blocks resonant circuit current from flowing during a predetermined first or second cycle of the self-oscillating circuit when the lamp is coupled to the ballast circuit and the second cathode of the lamp has failed.

8. The ballast circuit of claim 7, wherein the self-oscillating circuit is prevented from oscillating and the ballast circuit is protected from self-destruction when a lamp is coupled to the ballast circuit and the second cathode of the lamp has failed.

9. A ballast circuit for driving a fluorescent lamp, comprising:

a self-oscillating circuit for producing a periodic a.c. signal having a first cycle and a second cycle; and a series resonant circuit operationally coupled to the self-oscillating circuit and adapted for operationally coupling with a first and second cathode of the lamp, the resonant circuit further including:

a resonant inductor operationally coupled to the self-oscillating circuit, a resonant capacitor, a first diode with an anode lead and a cathode lead operationally coupled between the resonant inductor and resonant capacitor and adapted for operationally coupling across the first cathode of the lamp, and a second diode with an anode lead and a cathode lead operationally coupled between the resonant capacitor and the self-oscillating circuit, wherein the leads of the second diode are in an opposite orientation from the leads of the first diode with respect to the series resonant circuit, and the second diode being adapted for operationally coupling across the second cathode of the lamp;

wherein the first diode substantially blocks resonant circuit current from flowing during a predetermined first or second cycle of the self-oscillating circuit when no lamp is coupled to the ballast circuit.

10. The ballast circuit of claim 9, wherein the second diode substantially blocks resonant circuit current from flowing during the opposite cycle of the self-oscillating circuit from the cycle in which current is substantially blocked by the first diode when no lamp is coupled to the ballast circuit.

11. The ballast circuit of claim 10, wherein the self-oscillating circuit is prevented from oscillating and the ballast circuit is protected from self-destruction when no lamp is coupled to the ballast circuit.

12. A ballast circuit for driving a fluorescent lamp, comprising:

a self-oscillating circuit for producing an a.c. signal;

a resonant inductor with first and second leads, the first lead operationally coupled to the self-oscillating circuit;

a resonant capacitor with first and second leads;

a first diode with an anode lead operationally coupled to the first lead of the resonant capacitor and a cathode lead operationally coupled to the second lead of the resonant inductor; and a second diode with an anode lead operationally coupled to the second lead of the resonant capacitor and a cathode lead operationally coupled to the self-oscillating circuit;

wherein the first diode is adapted for operationally coupling with a first cathode of the lamp and the second diode is adapted for operationally coupling with a second cathode of the lamp;

wherein the first and second diodes: a) cause less power to be dissipated by the first and second lamp cathodes when the lamp is coupled to the ballast circuit and increase lamp life, b) protect the ballast circuit from self-destruction when no lamp is coupled to the ballast circuit, and protect the ballast circuit from self-destruction when either the first, second, or both cathodes of the lamp coupled to the ballast have failed.

13. A series resonant circuit for a ballast circuit, wherein the ballast circuit is adapted for driving a fluorescent lamp, the series resonant circuit comprising:

a resonant inductor adapted for operationally coupling with a self-oscillating circuit of the ballast circuit;

a resonant capacitor with first and second leads;

a first diode with an anode lead and a cathode lead operationally coupled between the resonant inductor and resonant capacitor and adapted for operationally coupling with a first cathode of the lamp; and a second diode with an anode lead and a cathode lead operationally coupled between the resonant capacitor and the self-oscillating circuit and adapted for operationally coupling with a second cathode of the lamp;

wherein the first and second diodes protect the ballast circuit from self-destruction.

14. The series resonant circuit of claim 13, wherein the first and second diodes cause less power to be dissipated by the first and second lamp cathodes when the lamp is coupled to the ballast circuit and increase lamp life.

15. The series resonant circuit of claim 13, wherein the first and second diodes protect the ballast circuit from self-destruction when the lamp is coupled to the ballast circuit and either the first, second, or both cathodes of the lamp have failed.

16. The series resonant circuit of claim 13, wherein the first and second diodes protect the ballast circuit from self-destruction when no lamp is coupled to the ballast circuit.

* * * * *